United States Patent [19]

Bakula et al.

[11] Patent Number: 4,869,023

[45] Date of Patent: Sep. 26, 1989

[54] ALIGNING AND LATCHING MECHANISM FOR A HINGED DOOR OF A CARGO CONTAINER

[75] Inventors: Robert J. Bakula; Dennis A. Curnes, both of Kenosha, Wis.

[73] Assignee: White Welding and Mfg., Inc., Kenosha, Wis.

[21] Appl. No.: 300,017

[22] Filed: Jan. 23, 1989

[51] Int. Cl.[4] ..... E05C 3/04

[52] U.S. Cl. ..... 49/395; 292/241; 49/396

[58] Field of Search ..... 49/394, 395, 396; 292/241, 218, 194, 240, 210

[56] References Cited

U.S. PATENT DOCUMENTS

| | | | |
|---|---|---|---|
| 2,861,830 | 5/1953 | Bennett . | |
| 3,132,893 | 5/1964 | Herr et al. | 49/395 |
| 3,329,456 | 7/1967 | Olander | 292/241 |
| 3,484,127 | 12/1969 | Pastva . | |
| 3,572,794 | 5/1971 | Pastva . | |
| 3,695,661 | 10/1972 | Pastva | 292/240 |
| 3,806,173 | 4/1974 | Sweda . | |
| 4,029,349 | 6/1977 | Sweda . | |
| 4,068,409 | 1/1978 | White | 49/396 |
| 4,087,122 | 5/1978 | Shaw et al. | 292/241 |
| 4,232,891 | 11/1980 | Ringe . | |
| 4,235,463 | 11/1980 | Benevenuta | 292/218 |
| 4,483,557 | 11/1984 | Pastva . | |
| 4,601,501 | 7/1986 | Pastva | 292/218 |

*Primary Examiner*—Kenneth J. Dorner
*Assistant Examiner*—Gerald A. Anderson

[57] ABSTRACT

A mechanism including a latch and keeper adapted to cooperate in an interengaging relationship relative to each other to facilitate aligning and latching of a hinged cargo container door. The latch is attached to one end of a rotatable shaft which is rotatably mounted parallel to an outer face of the door and is substantially immovable in an axial direction in relation to the door. The keeper is attached to a transverse member of a door frame on the cargo container. A device for rotating the shaft and thereby moving the latch into a cooperative relationship with the keeper is also provided. The latch has an elongated wedge-shaped finger defining inner and outer curved camming surfaces. The keeper includes a base portion and first and second projecting portions at each end of the base portion. The keeper defines spaced apart inner and outer curved camming surfaces which define a latch locking zone therebetween. When the latch is in a closed position relative to the respective keeper, the inner curved camming surface on the latch and the inner curved camming surface on the keeper are arranged adajcent and substantially parallel to each other. As such, an opening force is imparted to the door substantially coincident with rotation of the shaft in an opening direction.

5 Claims, 4 Drawing Sheets

ALIGNING AND LATCHING MECHANISM FOR A HINGED DOOR OF A CARGO CONTAINER

FIELD OF THE INVENTION

The present invention generally relates to large cargo containers and, more particularly, to a mechanism for aligning and latching doors of a cargo container.

BACKGROUND OF THE INVENTION

Large cargo containers and the like having enclosed bodies are conventionally provided with a rectangular door frame at one end of the container. A pair of doors, which are adapted to be swung within the plane of the door frame, are typically provided for closing the door frame. A rotary bar locking mechanism selectively retains the doors within the door frame. The doors on the container are constructed as large as possible to facilitate loading and unloading of the container.

The size of many cargo containers is substantially regulated by Industry standards. That is, Industry standards regulate the height of the container as measured from a road bed and the width of the container. Standard sized wheel trucks govern the distance between the road bed and a base of the cargo container.

In that the outside measurements of the container are substantially regulated by Industry standards, the container is typically fabricated from relatively thin materials to maximize internal cargo space, transport capability, and for purposes of economy. The door frame of the container comprises top and bottom transverse frame members including an upper header and a lower sill and vertical side members. The frame members are suitably welded at their adjacent corners.

To promote loading and unloading of the cargo container and to maximize interior cargo space, the door frame is usually fabricated of structural members having the least strength practical. To further facilitate the loading and unloading of the container, the top transverse frame member or header should be fabricated as narrow as possible so as to not hinder loading and unloading of the cargo container.

Because of its relatively large size and the weakness of its structural members, under certain circumstances, such as when a racking action is applied to the container, the door frame is subject to considerable distortion. When a racking action is applied to the container, the header moves, or tends to move, relative to the sill in a path that is transverse to the length of the cargo container and generally parallel to the sill. Such racking action tends to occur if the vehicle is not standing in a level position so that its rear wheels are on different levels; it also tends to occur from twisting or jostling of the body during travel, particularly at high speeds.

It is common practice to utilize the doors, when closed, to stiffen the frame of the cargo container. The rotary bar locking mechanism associated with each door on the cargo container is used to align the respective door relative to the door frame and retain the doors in a closed position within the door frame thereby adding stiffness to the cargo container frame.

Each rotary bar locking mechanism typically includes a shaft rotatably attached on the exterior side of each door and extends parallel to the pivot axis of the door along or adjacent to the door's free end. A handle is fixed to the shaft to facilitate rotation thereof. A latch is typically provided at opposite ends of the shaft. Each latch is adapted to coact with a keeper secured to the respective header and sill of the door frame. Each latch is typically provided with an elongated and tapering cam finger which coacts with a respective keeper to provide a useful mechanical advantage to close the door even though the door frame may be twisted because the vehicle is parked on uneven terrain.

An elastomeric frost seal is commonly used to form an air tight closure between the doors and the frame. When the truck has two adjacent pivot doors, a frost seal is also fixed to the free end of one of the doors and forms and air tight seal between the doors.

The rotary bar locking mechanism must be effective to release the doors in minimum time and with minimum difficulty even under severe and abnormal conditions. Such severe and abnormal conditions arise in service due to factors such as distortion or sagging of one of the doors or the presence of ice, dirt and the like in the bar locking mechanism.

SUMMARY OF THE INVENTION

In view of the above, and in accordance with the present invention, there is provided a mechanism which facilitates alignment of a door of a cargo container and latching thereof in a closed position. The mechanism of the present invention offers an improved camming action which imparts an opening force to the door substantially coincident with operation of an actuating handle in an opening direction sufficient to generate an opening force to break the door seal when opening the door.

The cargo door which is to be aligned and latched by the present invention is hinged to a door frame of a cargo container. The door frame includes a transverse header defining an upper edge of the door frame and a transverse sill at the lower end of the door frame.

The aligning and latching mechanism of the present invention includes a vertically extending shaft which is rotatably mounted parallel to an outer face of a cargo container door about a substantially fixed vertical axis. The shaft is laterally spaced from the hinged edge of the door and is substantially immovable in an axial direction in relation to the door. A suitable handle facilitates rotation of the shaft under the influence of an operator Rotation of the handle in a first direction, typically toward the door, causes the door to be urged toward the frame. Rotation of the handle in the opposite direction ultimately results in opening of the door.

First and second latches are connected to opposite ends of the shaft. Each latch includes a vertical stem portion which is axially aligned and rotates with the shaft. An elongated wedge shaped locking tongue portion extends from the stem portion of the latch in a first lateral direction and has inner and outer curved camming surfaces. A heel portion extends from the stem portion of the latch in an opposite lateral direction from the tongue portion. The heel portion has upper and lower faces which converge toward the free end of the heel portion and a substantially linear abutment surface.

The aligning and latching mechanism of the present invention further includes first and second keepers, with each keeper being respectively secured to one of the header and sill of the door frame. Each keeper comprises a base portion which is fixedly secured to the respective header and sill of the door frame. Each keeper further includes first and second spaced projecting portions which are connected to opposite ends of the base portion.

The first projecting portion on each keeper comprises an outer curved camming surface which is joined to the base portion by a wedge-like stem portion defining a cam surface. The second projecting portion on each keeper member comprises two vertically spaced fork-like projections defining a wedge-shaped opening therebetween. The wedge-shaped opening is adapted to accommodate the heel portion of the respective latch in a manner aiding alignment of the door relative to the door frame.

Each latch is adapted to move in a substantially horizontal path into and out of a locked position with its respective keeper in response to rotation of the shaft in a first direction. The movement of a latch toward a locked position with its respective keeper results in the locking tongue portion of the latch cooperating with the wedge-like stem portion and the outer curved camming surface on the respective keeper to vertically align the door relative to the door frame simultaneously with the forceable closing of the door.

During its movement to its locked position, the latch passes through an over-centering conditing relative to the outer camming curved surface on the respective keeper. Movement of the latch toward a locked position with its respective keeper continues until the linear abutment surface on the heel portion of the latch contacts the base portion of the associated keeper. When the mechanism of the present invention has reached its closed position, the axis of rotation of the shaft lies closer to the door frame than does the outer cam surface on the associated keeper.

To facilitate opening of the doors, the first projecting portion on at least one of the keepers further comprises an inner curved camming surface. This inner curved camming surface is spaced from the outer curved camming surface on the first projecting portion to define a latch locking zone therebetween. The inner curved camming surface on the keeper is configured such that when the respective latch is in a locked position with the keeper, the inner curved camming surface on the latch and the inner curved camming surface on the respective keeper are arranged adjacent and substantially parallel to each other. As such, an opening force is imparted to the door substantially coincident with rotation of the shaft in an opposite direction. As will be appreciated, it is during initial rotation of the shaft that the operator has the best ergonomic position and greatest mechanical advantage to provide an opening force to the door.

In a preferred form of the invention, the stem portion of each latch is telescopically received within the shaft and is fixedly connected thereto. In this manner, the axis of rotation of the shaft lies closer to the door frame than does the outer camming surface of the keeper when the door is in a closed position.

In a preferred form of the invention, a keeper with an inner curved camming surface is secured to the narrow header on the door frame. Moreover, each latch further includes an annular collar which is vertically spaced from the locking tongue portion and the heel portion. At least the end portions of the shaft are tubularly configured to receive the stem portion of a latch. The end of the shaft abuts against this annular collar during vertical door alignment.

To facilitate the door closing movements, the inner and outer curved caming surfaces on the first keeper member converge relative to each other in the first lateral direction.

The present invention provides a relatively inexpensive device which will forceably align a door relative to a door frame and subsequently lock the door in place in a manner preventing inadvertant opening of the door. When it is necessary, however, to open the door, the design of the present invention offers an improved camming action which, upon initial movement of the shaft, will impart an opening force to the door whereby freeing it from the door frame regardless of the adverse conditions to which the cargo container may be subjected.

Numerous other features and advantages of the present invention will become readily apparent in the following detailed description, the appended claims, and the accompanying drawings.

DETAILED DESCRIPTION OF PRESENT INVENTION

Figure 2:
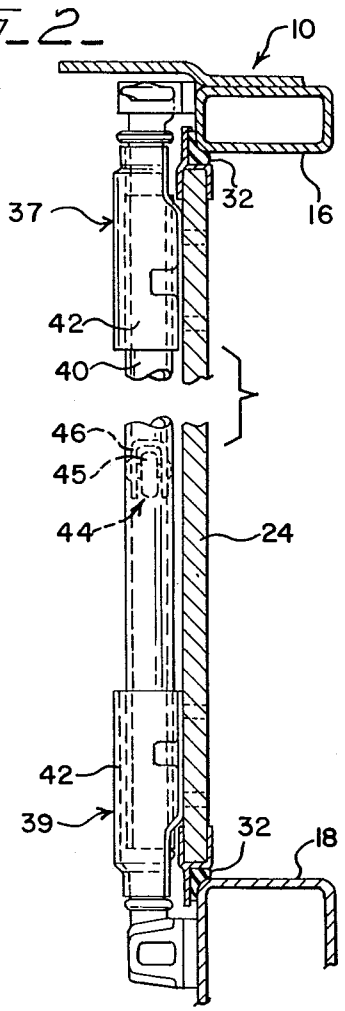
FIG. 2 is a partial sectional view taken along line 2—2 of FIG. 1.

While the present invention is susceptible of embodiment in various forms, there is shown in the drawings and will hereinafter be described, a preferred embodiment of the invention with the understanding that the present disclosure is to be considered as an exemplification of the invention and is not intended limit the invention to the specific embodiment illustrated.

Figure 1:
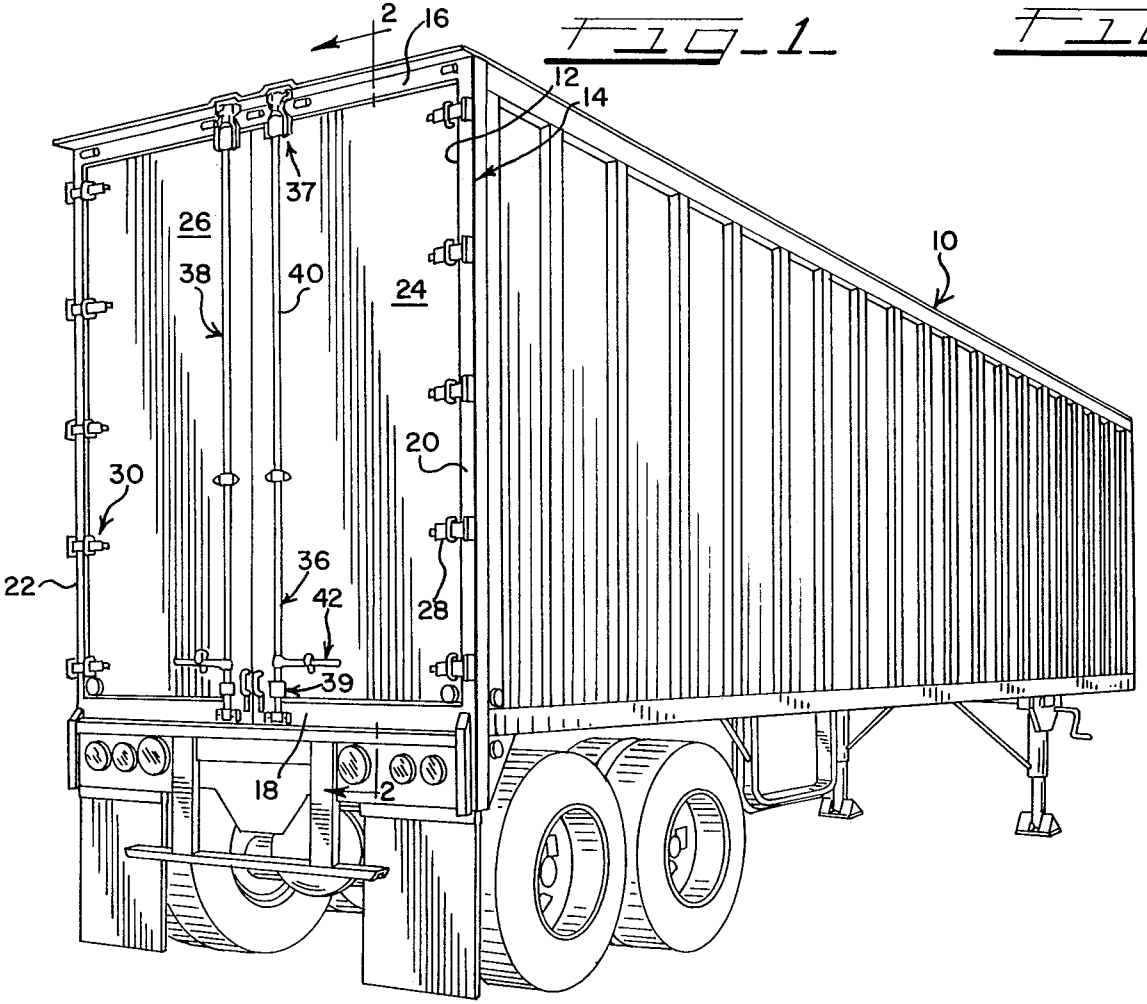
FIG. 1 is a perspective view of a truck-trailer to which is applied an aligning and latching mechanism according to the present invention.

Referring now to the drawings, wherein like reference numerals indicate like parts throughout the several views, FIG. 1 illustrates a trailer truck body 10 having, at its rear end, a doorway opening 12. The doorway opening 12 is defined by a door frame 14 including a header 16 transversely extending across an upper edge of the door frame and a sill 18 transversely extending across a lower edge of the door frame. Upright side members 20 and 22 join the header and sill. Disposed within the door frame 14 for closing the same are a pair of doors 24 and 26 which are connected to the side members 20 and 22 by means of hinges 28 and 30 which allow each door to be swung within a plane defined by the door frame 14.

Turning to FIG. 2, to provide a suitable seal closure between a door and the truck body 10, resilient strip material 32 of suitable cross sectional configuration may be secured about the edges of the doors. The strip material 32 along one vertical edge of a door may be arranged to overlap the vertical edge of the other door.

Doors 24 and 26 are adapted to be secured within the door frame 14 by aligning and latching mechanisms 36 and 38. Since the aligning and latching mechanisms 36, 38 are mirror images of each other, any description hereafter of one aligning and latching mechanism, and components associated therewith, will also pertain to the other aligning and latching mechanism.

As illustrated in FIG. 2, each aligning and latching mechanism includes first and second attachment mechanisms 37 and 39, arranged at opposite ends of a vertically extending shaft 40, and a handle mechanism 44 by which shaft 40 may be manually partially rotated.

Shaft 40 is rotatably arranged parallel to an outer face of the door to which it is mounted about a substantially fixed vertical axis. The shaft 40 is laterally spaced from the hinged edge of the door. Each end of shaft 40 is mounted in a bracket 42 forming part of an attachment mechanism such that the shaft is substantially immovable in an axial direction in relation to the door to which it is mounted. The attachment mechanism 37, 39 for rotatably mounting the shaft to the door may be of the type illustrated in U.S. Pat. No. 4,068,409 to C. E. White; the full teachings of which are incorporated herein by reference.

The handle mechanism 44 of each aligning and latching mechanism includes a hand lever 45 which is pivotly attached to shaft 40. Each lever 44 is normally retained in a locked position against the door by a suitable retainer 46.

Figure 3:
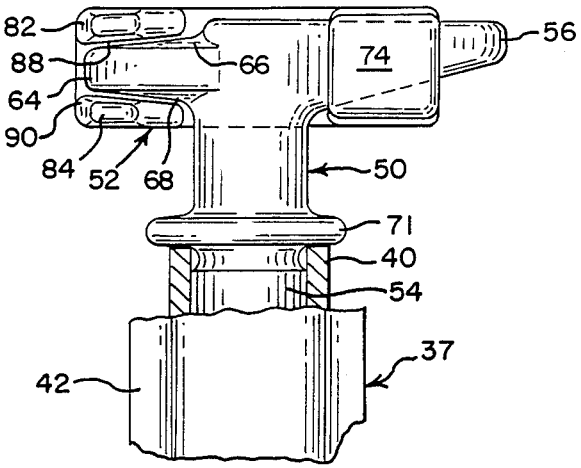
FIG. 3 is a front elevational view, partially broken away, showing the aligning and latching mechanism in a closed position.
Figure 4:
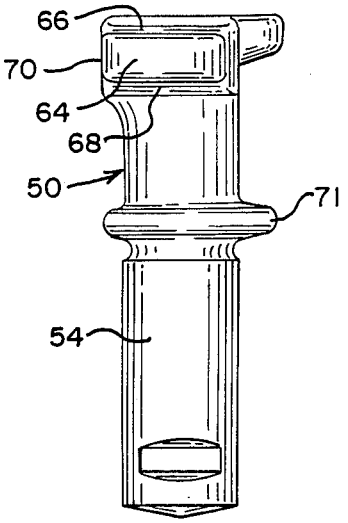
FIGS. 4 thru 7 illustrate various views of a latch associated the present invention.

Turning to FIG. 3, each attachment mechanism 37, 39 comprises a latch 50 and keeper 52. The latch 50 cooperates keeper 52 in an interengaging relationship to maintain the respective door in a closed position. Each latch 50 is connected to an end of shaft 40 such that it rotates in response to movement of the handle mechanism 44 by the operator. Each latch 50 is preferably formed from forged steel and comprises a central vertical stem portion 54 that extends into and is fixed to shaft 40. As illustrated in FIG. 3, shaft 40, at least at its end portions, has a tubular construction.

Figure 7:
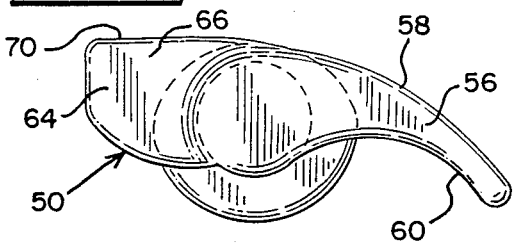
Figure 5:
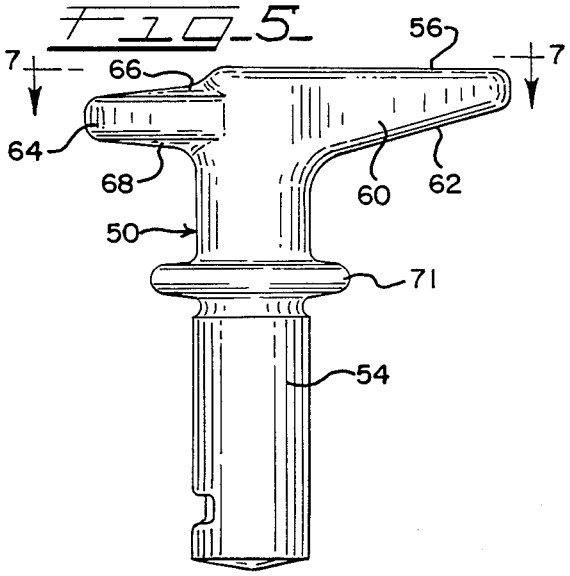
Figure 6:
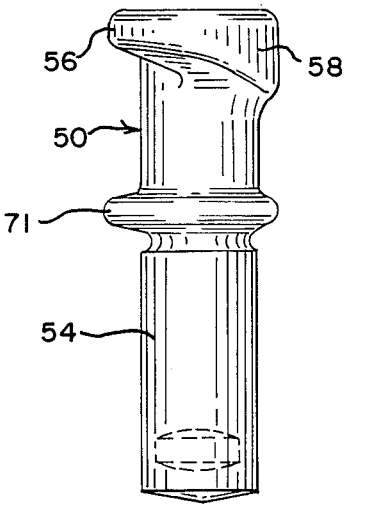

Referring now to FIGS. 5 through 7, an elongated wedge shaped locking tongue portion 56 is formed integrally with and extends from stem portion 54 in a first lateral direction and is moved horizontally when shaft 40 is rotated by the handle mechanism 44. The locking tongue portion 56 of each latch 50 defines inner and outer curved caming surfaces 58 and 60 respectively. Moreover, an under side edge of the locking tongue portion defines a cam surface 62 which tapers toward the free end of the locking tongue.

Each latch 50 further defines a heel portion 64 which is formed integral with and extends from stem portion 54 in an opposite lateral direction from tongue portion 56. The heel portion 64 of each latch 50 defines upper and lower faces 66 and 68, respectively, which converge toward a free end of heel portion 64. Heel portion 64 of each latch further defines a substantially linear abutment surface 70.

Each latch 50 further includes an annular collar 71 which is vertically spaced from the locking tongue portion 56 and heel portion 64. The collar 71 bears against the end of the tubular portion of shaft 40 in a manner aiding alignment of the door being aligned and closed.

Figure 8:
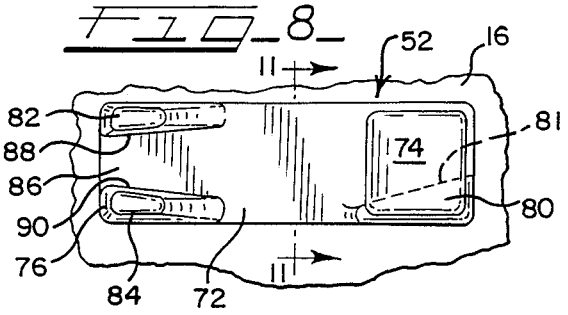
FIGS. 8 thru 12 illustrate various views of a keeper associated with the present invention.
Figure 9:
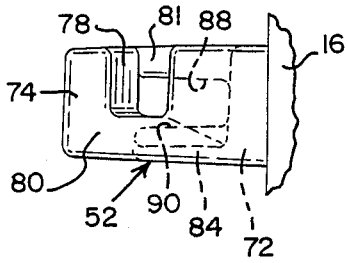
Figure 10:
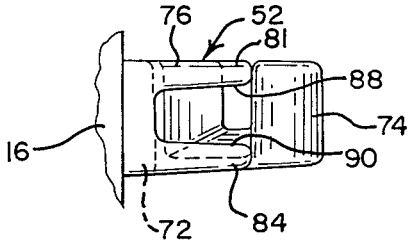
Figure 11:
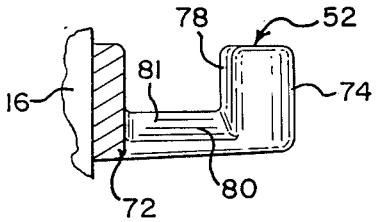
Figure 12:
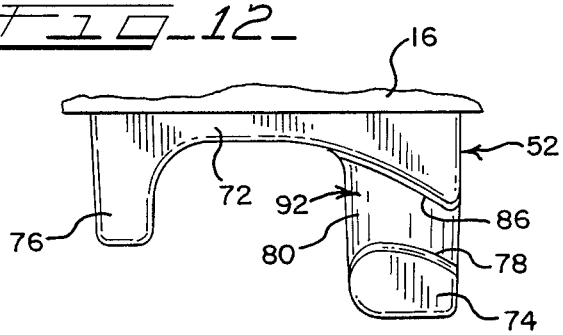
Figure 13:
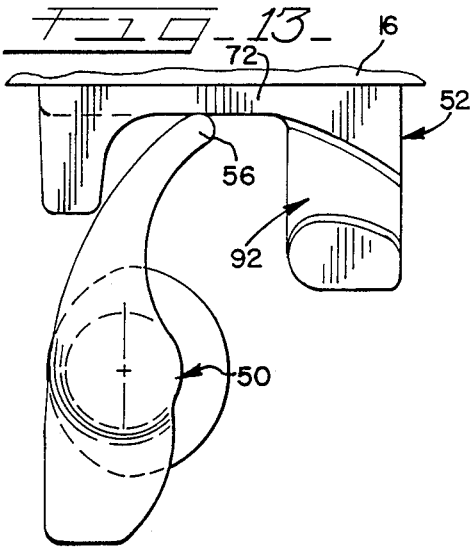
FIGS. 13 thru 16 are diagrams showing progressive positions of the latching and aligning mechanism of the present invention.

Particularly as illustrated in FIGS. 8 through 12, the keeper 52 of each mechanism 37, 39 comprises a base portion 72 with first and second projecting portions 74 and 76, respectively, connected to opposite ends of base portion 72. Particularly as illustrated in FIG. 12, the first projecting portion 74 on each keeper comprises an outer curved caming surface 78 having a generally convex profile. The caming surface 78 is joined to base portion 72 of the keeper member by a wedge-like stem portion 80 which is preferrably integral with base 72 and the first projecting portion 74. As illustrated in FIG. 8, the wedge-like stem portion 80 defines a cam surface 81.

The second projecting portion 76 on each keeper comprises two vertically spaced fork-like projections 82 and 84 defining between them a wedge shaped opening 86 adapted to fit closely but clear the upper and lower faces 66, 68, respectively, of the heel portion 64 of an associated latch 50. Moreover, confronting inner facing surfaces 88 and 90 of the projections 82 and 84, respectively, define caming surfaces adapted to wedgingly engage faces 66 and 68, respectively, of an associated latch 50 when the latch is being moved into a lock position.

As mentioned a keeper of each aligning and latching mechanism is attached to the header 16 of the door frame 14. Preferrably, the keeper associated with the header 16 further includes an inner curved caming surface 86 (FIG. 12) on the first projecting portion 74 of the keeper member. The inner curved caming surface 86 is spaced from the outer curved caming surface 78 to define a latch locking zone 92 therebetween.

A door closing sequence can best be understood by referring to FIGS. 13 thru 16 which schematically illustrates a latching and aligning mechanism for door 26 of the trailer body 10. When desired, the door 26 is moved toward a closed position relative to the doorway opening 12 with the hand lever 45 of the handle mechanism 44 in an open position extending approximately normal to the plane of the door.

The door 26 can be partially closed with the handle mechanism 44 in an open position until a distal end of the locking tongue portion 56 on latch 50 contacts base portion 72 of an associated keeper 52. The abutment of the tongue portion 56 of latch 50 with base portion 72 of an associated keeper 52 causes the locking tongue portion 56 to be guided within the locking zone 92 of the keeper 52. The extended length of locking tongue portion 56 aids in guiding the associated door and latch into proper alignment with the parts with which they are to cooperate.

Figure 14:
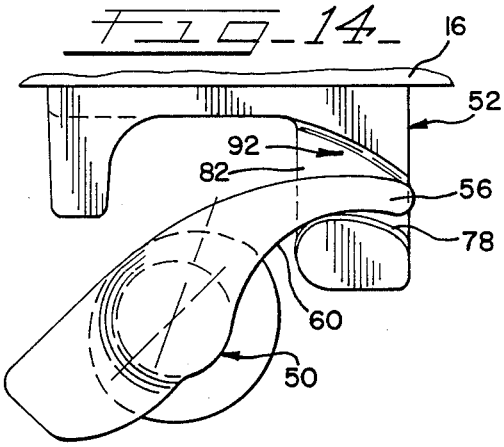

During door closing and as schematically illustrated in FIG. 14, the handle mechanism 44 is rotated during closing of the door to turn the locking tongue portion 56 of the latch through the latch locking zone 92 on the respective keeper 52. As the locking tongue portion 56 passes through the latch locking zone, underside cam surface 62 on the locking tongue portion cooperates with the cam surface 81 on the keeper to vertically align the associated door relative to the door frame while simultaneously the outer cam surface 78 on the keeper coacts with the outer cam surface 60 on the locking tongue portion 56 of latch 50 in a manner closing the door.

Figure 15:
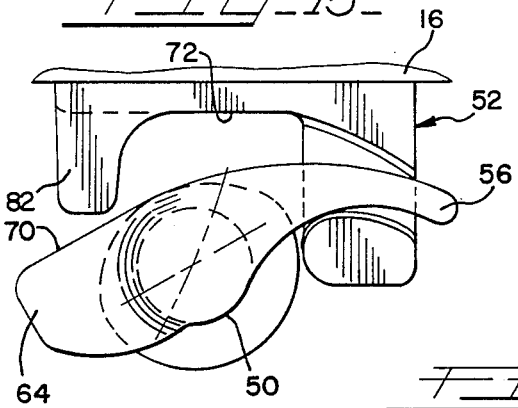

As viewed in FIGS. 3 and 15, continued rotation of shaft 40 by the handle mechanism 44 causes the heel portion 64 of the latch 50 to pass between the forked projections 82, 84 on the keeper 52. The upper and lower faces 66, 68, respectively, on the heel portion 64 cooperate with the camed surfaces 88 and 90 on the keeper to provide a wedging action that drives the door firmly into alignment relative to the door frame.

Figure 16:
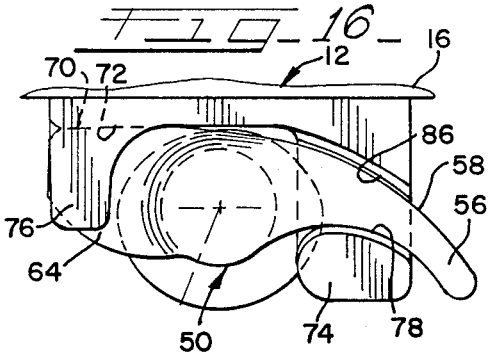

Continual rotation of the handle mechanism 44 causes the locking tongue portion 56 to pass through the latch locking zone until the abutment surface 70 on the heel portion 64 of the latch 50 contacts the base portion 72 of the associated keeper member (FIG. 16). When the aligning and latching mechanism has reached its closed position, as illustrated in FIG. 16, the axis of rotation of the shaft 40 has passed an over-centering condition relative to the outer curved camming surface 78 on an associated keeper 52 and lies closer to the door frame 14 than does the outer curved caming surface 78 on the respective keeper.

In such a closed position, and as best illustrated in FIG. 16, the inner curved caming surface 86 on the keeper 52 and the inner curved cam surface 58 defined by the locking tongue portion 56 of the respective latch 50 are arranged adjacent and substantially parallel to each other along an extended portion of their length. The interengaged locking tongue portion 56 and heel portion 64 of the latch 50 with the first and second projections 74 and 76, respectively, on the respective keeper 52 reenforce the associated door and door frame thus resisting racking forces imposed thereon. Squarely securing the door within the door frame minimizes or wholly eliminates S-bending of the header 16 and sill 18.

After the latch 50 has been positioned into locking engagement with the associated keeper 52, the hand lever 45 extends substantially parallel with outer face of the door and is secured by the retainer 46. Door 24 may be closed and locked in a corresponding manner.

When the doors 24 and 26 are to be opened, the handle mechanism 44 on the associated door is operated to open the door. The hand lever 45 of the handle mechanism 44 is freed from the retainer 46 and is rotated outwardly away from the face of the door. With the hand lever 45 of mechanism 44 extending generally parallel to the door, the operator opening the door is in an advantageous ergonomic position to apply the greatest mechanical advantage to open the door. As will be understood, the outward motion of the hand lever 45 is translated into rotation of the shaft 40.

Returning to FIG. 16, because the inner curved camming surface 58 on the latch 50 and the inner curved camming surface 86 on the respective keeper 52 are arranged adjacent and substanially parallel to each other along an extended portion of their length, a positive and substantially immediate reaction force is imparted to the door substantially coincident with rotation of shaft 40 by the handle mechanism 44. As a result of the combined action between surface 58 on latch 50 and surface 86 on keeper 53, an opening force is almost immediately imparted to the door in minimum time and with minimum difficulty even under severe and abnormal conditions which arise in service do to factors such as distortion, or the presence of ice, dirt and the like in the aligning and latching mechanism.

Figure 17:
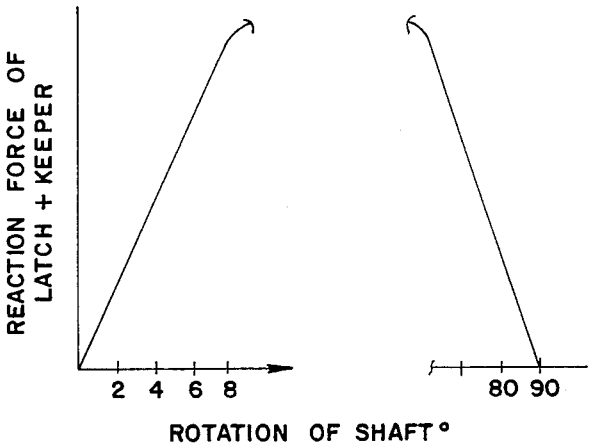
FIG. 17 is a graph schematically illustrating a plot of forces developed by the mechanism of the present invention against angular rotation of a shaft.

As is apparent from FIG. 17, a positive reaction force for facilitating opening a door is almost immediately provided by the present invention coincident with rotation of shaft 40. The improved structure of the present invention is provided to enhance performance of the aligning and latching mechanism during an opening sequence for the doors of the cargo container.

This invention has been described in terms of a specific embodiment set forth in detail, but it should be understood that this is by way of illustration only and that the invention is not necessarily limited thereto. Modifications and variations will be apparent from the disclosure and may be resorted to without departing from the spirit of the invention, as those skilled in the art will readily understand. Accordingly, such variations and modifications of the disclosed products are considered to be within the purview and scope of the invention and the following claims.

What is claimed is:

1. An aligning and latching mechanism for a door hinged to a door frame of a cargo container, said door frame including a transverse header defining an upper edge of said door frame and a transverse sill at the lower edge of said door frame, said aligning and latching mechanism comprising:

a vertically extending shaft rotatably mounted parallel to an outer face of said door about a substantially fixed vertical axis laterally spaced from the hinged edge of the door, said shaft being substantially immovable in an axial direction in relation to said door;

means for rotating said shaft about its axis;

first and second latches connected to opposite ends of said shaft, each latch comprising a vertical stem portion which is axially aligned and rotates with said shaft, an elongated wedge shaped locking tongue portion extending from the stem portion in a first lateral direction and having inner and outer curved camming surfaces, and a heel portion extending from said stem portion in an opposite lateral direction from said tongue portion, said heel portion having upper and lower faces which converge toward a free end of said heel portion and a substantially linear abutment surface;

first and second keeper members each respectively secured to one of the header and sill of said door frame, each keeper member comprising a base portion fixedly secured to the respective header and sill of said door frame, first and second spaced projecting portions connected to opposite ends of said base portion, the first projecting portion on each keeper member comprising an outer curved camming surface which is joined to said base portion by a wedge-like stem portion defining a cam surface, the second projecting portion on each keeper member comprising two vertically spaced fork-like projections defining a wedge shaped opening therebetween which accommodates the heel portion of the respective latch in a manner aiding alignment of the door relative to said door frame and whereby each latch is adapted to move in a substantially horizontal path into and out of a locked position with its respective keeper member in response to rotation of said shaft in a first direction, the movement of each latch toward a locked position with its respective keeper member resulting in said locking tongue portions cooperating with the wedge-like stem portions and said outer curved camming surfaces on said keeper members to vertically align the door relative to said door frame simultaneously with the forcible closing of said door, the movement of the latch toward a locked position with its respective keeper member continuing until the linear abutment surface on said heel portion of said latch contacts said base portion of the associated keeper member and whereat the axis of rotation of said shaft lies closer to said door frame than does the outer curved camming surface on said keeper members;

wherein the first projecting portion on at least one of said keeper members further comprises an inner curved camming surface spaced from said outer curved camming surface to define a latch locking zone therebetween, the inner curved camming surface on said one of said keeper members being configured such that when the respective latch is in a locked position the inner curved camming surface thereon and the inner curved camming surface on the respective keeper are arranged adjacent and substantially parallel to each other whereby an opening force is imparted to said door substantially coincident with rotation of said shaft in an opposite direction.

2. The aligning and latching mechanism according to claim 1 wherein said stem portion of each latch is telescopically received within said shaft and is fixedly connected thereto.

3. The aligning and latching mechanism according to claim 1 wherein said first keeper member is secured to said header of the door frame.

4. The aligning and latching mechanism according to claim 1 wherein each latch further includes an annular collar vertically spaced from said locking tongue portion and said heel portion and against which said shaft abuts during vertical door alignment.

5. The aligning and latching mechanism according to claim 1 wherein the inner and outer curved camming surfaces on said first keeper member converge relative to each other in the first lateral direction.

* * * * *